United States Patent [19]

Panzer et al.

[11] 4,363,724

[45] Dec. 14, 1982

[54] USE OF $C_{8-34}$ ALPHA OLEFIN SULFONATES TO IMPROVE AND ENHANCE THE FLOTATION AND COLLECTION PROCESS USED FOR BARITE

[75] Inventors: George W. Panzer, Timonium; William Boyer, Baldwin, both of Md.

[73] Assignee: Alcolac, Inc., Baltimore, Md.

[21] Appl. No.: 181,658

[22] Filed: Aug. 26, 1980

[51] Int. Cl.[3] ..... B03D 1/02

[52] U.S. Cl. ..... 209/166; 252/61; 252/555

[58] Field of Search ..... 209/166, 167; 200/504 A; 252/61, 555

[56] References Cited

U.S. PATENT DOCUMENTS

| | | | |
|---|---|---|---|
| 2,433,258 | 12/1947 | Booth | 209/166 |
| 2,739,124 | 3/1956 | Oito | 260/504 A X |
| 2,834,463 | 3/1958 | Vincent | 209/166 |
| 2,970,692 | 2/1961 | Henderson | 209/166 |
| 3,685,652 | 8/1972 | Chentob | 209/166 |
| 4,157,296 | 1/1979 | Dorrepael | 209/167 |
| 4,192,739 | 3/1980 | Nawg | 209/166 |

FOREIGN PATENT DOCUMENTS

| | | | |
|---|---|---|---|
| 850431 | 9/1952 | Fed. Rep. of Germany | 209/166 |
| 837019 | 10/1938 | France | 209/160 |
| 904213 | 2/1945 | France | 209/166 |
| 417705 | 2/1946 | Italy | 209/166 |
| 294644 | 3/1971 | U.S.S.R. | 209/166 |
| 415050 | 9/1974 | U.S.S.R. | 252/61 |
| 706130 | 7/1978 | U.S.S.R. | 209/166 |

*Primary Examiner*—Ralph J. Hill

*Attorney, Agent, or Firm*—Finnegan, Henderson, Farabow, Garrett & Dunner

[57] ABSTRACT

A method of beneficiating ore containing barite by a froth flotation process. $C_{8-34}$ alpha olefin sulfonates and salts thereof are the active component in compositions which are effective barite collectors and frothers. Additionally, the alpha olefin sulfonates can be admixed with $C_{8-34}$ alkyl sulfates, salts thereof, tall oil fatty acids, salts thereof, mahogany petroleum sulfonates, salts thereof, sulfosuccinamates, salts thereof, as well as with admixtures of these compounds to achieve compositions which are efficient barite collectors and frothers.

14 Claims, No Drawings

USE OF $C_{8-34}$ ALPHA OLEFIN SULFONATES TO IMPROVE AND ENHANCE THE FLOTATION AND COLLECTION PROCESS USED FOR BARITE

BACKGROUND OF THE INVENTION

This invention relates to the flotation of barite from gangue contained in barite ores and is particularly directed to a novel frothing and collecting composition and admixtures of the active component of this novel composition with previously used barite collectors, which admixtures are efficient in carrying out the flotation of barite.

The old and well-known process of beneficiating ores by means of froth flotation has been applied to the beneficiation of numerous ores. Briefly, in a froth flotation process, an ore is finely ground, the resulting fine material is suspended in water to form a fluid pulp, the entire mass is agitated and aerated in the presence of a collector and a frothing agent to form a froth floating on the surface of the liquid, and the froth, containing a high concentration of a desired mineral, is skimmed off.

In this process, the collector, a chemical, must attach itself to the surface of the desired heavy mineral particles, thus giving the mineral particles a hydrocarbon-like surface layer, usually of monomolecular thickness, which is capable of adhering to air bubbles. The air bubbles carry the heavy mineral upward into the froth where it may be skimmed off by any suitable skimming device.

Obviously, the collector used for the beneficiation of any particular ore must be highly selective, so as to form films exclusively upon the surface of the desired mineral and not upon the gangue. This selectively allows floating of only the desired mineral particles, whereas the undesired gangue remains in the tailings.

Barite, or native barium sulfate, $BaSO_4$, is an important mineral with wide industrial applications. Because many of the higher grade deposits of barite in the United States have been worked out, miners of this material have been forced to obtain increasing amounts of barite from lower grade ore bodies, including tailing ponds, wherein the barite is present with gangue minerals such as limestone and various silicious minerals such as quartz, clay minerals, feldspar and the like. As a result, froth flotation for the beneficiation of barite is becoming increasingly more necessary.

One of the principal uses of barite floated from gangue minerals is as a weighting material for drilling mud used in the drilling of oil and gas wells. However, a mineral containing a hydrophobic coating is not well-suited for use in an aqueous drilling fluid. Rather, in a drilling fluid, a hydrophilic surface is desirable for deflocculation and proper dispersal of the weighting material products, as well as for avoiding foaming when the weighting material is added to a typical drilling mud. Preferably, therefore, a flotation reagent, to the extent it forms a hydrophobic coating, should be easily removed from the beneficiated mineral.

It is desirable moreover, that the temperature at which removal is effected be low enough to avoid an excessive proportion of soluble salts in the product. Such soluble salts are objectionable in the drilling mud field.

Moreover, barite used for weighting drilling muds should have a specific gravity of 4.20, preferably 4.25 or higher. A specific gravity below 4.20 is sometimes not commercially acceptable.

Accordingly, a flotation process for barite should yield a concentrate rich enough in barium sulfate to achieve the stated minimum of specific gravity. As a result of this consideration, metallurgical recovery in floating barite for oil-well drilling use is a secondary consideration; the primary consideration is the specific gravity of the barite, with the proviso, of course, that metallurgical losses should not be excessive.

Certain mixtures of tall oil fatty acids, sulfo succinamates, mahogany petroleum sulfonates and cetyl sulfate and tallow sulfate, both alkyl sulfates, and salts thereof, have previously been used alone or in admixtures with each other and found to be excellent collecting materials for the froth flotation of barite. These collectors are sufficiently specific in their collecting action for barium sulfate, as well as commercially acceptably removable from the beneficiated mineral at temperatures sufficiently low to prevent excessive formation of soluble salts in the barium product.

At their normally supplied commercial activity, however, these alkyl sulfates and other previously-used collectors are usually pastes at ordinary operating temperatures; thus, they are difficult to disperse in water, especially under winter conditions when the water is cold. Further, as pastes they must be added manually and cannot be metered into the process.

Further, with respect to the previous use of alkyl sulfates as barite collectors, the equivalent weight range is fairly narrow. Unless cetyl alkyl sulfates having a carbon length distribution of approximately 65% by weight $C_{16}$ and 35% by weight $C_{18}$ or tallow alkyl sulfates having a carbon length distribution of approximately 35% by weight $C_{16}$ and 65% by weight $C_{18}$ are used either alone or in an admixture, with no other alkyl sulfates being present, the efficiency from using alkyl sulfates as barite collectors in froth flotation falls off drastically.

The present invention overcomes many of the disadvantages of the prior art by providing a composition for enhancing the froth flotation and collection of barite. The compositions of the present invention are at their preferably supplied activity dispersions which are more highly liquid or fluid-like than these paste-like collecting compositions previously used, such as alkyl sulfates. Thus, the compositions of the present invention are advantageously more easily handled than those previously used pastes and can also be automatically metered into the froth flotation process, rather than added manually. These compositions retain their increased fluid-like or liquid properties at ordinary operating temperatures, at elevated operating temperatures and at temperatures down to approximately 40° F.

The active component of the composition of the present invention is acceptably selective to barite and is also acceptably removable from the beneficiated barite. Barite floated with this composition has an acceptable specific gravity and a commercially acceptable level of soluble salts.

Further, a composition containing the active component may serve both as a collector and a frothing agent, whereas many of the previously used collectors require use of a chemically distinct frothing agent.

Significantly, admixture of the active component of the composition of the present invention with previously-used collector pastes achieves admixtures which themselves are compositions falling within the scope of the present invention. At their preferably supplied activity, these admixtures are more highly liquid or fluid-like than the paste-like collecting composition that have been used previously.

Moreover, admixture of the active component of the composition of the present invention with alkyl sulfates, in addition to forming admixtures which at their preferably supplied activity are more highly liquid or fluid-like than the paste-like compositions previously used, also improves the efficiency of alkyl sulfates other than cetyl alkyl sulfates and tallow alkyl sulfates as barite collectors. Accordingly, alkyl sulfates heretofore unacceptable as barite collectors can now be used more efficiently when admixed with the active component of the composition of the present invention. Further, these previously unacceptable alkyl sulfates, when admixed with the active component of the composition of the present invention, can also be admixed with the previously acceptable $C_{16}$-$C_{18}$ alkyl sulfates. The resulting admixture, a composition which is an effective frother and barite collector, thus falls within the scope of the present invention.

SUMMARY OF THE INVENTION

As broadly stated, the present invention provides a method of beneficiating ore containing barite by a froth flotation process to produce a froth concentrate of barite while leaving gangue minerals in a tailing comprising the steps of suspending barite-containing ore in water; including in the suspension an effective amount of at least one compound selected from the group consisting of a $C_{8-34}$ alpha olefin sulfonate and a salt of a $C_{8-34}$ alpha olefin sulfonate; aerating the suspension to form bubbles containing barite-alpha olefin sulfonate complexes, recovering a froth concentrate relatively rich in barite; and leaving a tailing relatively poor in barite.

The invention further relates to a composition for enhancing the froth flotation and collection of barite comprising as an active component at least one compound selected from the group consisting of a $C_{8-34}$ alpha olefin sulfonate and a salt of a $C_{8-34}$ alpha olefin sulfonate.

The composition of the present invention can further include at least one other admixed compound selected from the group consisting of a tall oil fatty acid, a salt of a tall oil fatty acid, a mahogany petroleum sulfonate, a salt of a mahogany petroleum sulfonate, a sulfo succinamate, a salt of a sulfo succinamate, a $C_{8-34}$ alkyl sulfate, and a salt of a $C_{8-34}$ alkyl sulfate.

DETAILED DESCRIPTION OF THE PREFERRED EMBODIMENTS

In the prior art, methods of beneficiating ore containing barite by a froth flotation process and means for carrying out such methods are well-known. In general, the manipulative steps of the present flotation process are very similar to those of the prior art except for the presence of the particular novel liquid composition which serves as both a frother and a collector.

Generally, in beneficiating barite, the barite-containing ore is crushed and sized by milling to at least about 120 mesh, standard sieve, depending on the particular ore treated. Milling to finer sizes is preferred.

After grinding, the ore is suspended in water and introduced into a thickener, where a conventional flocculant, such as a mixture of high molecular weight polyacryl amides, may be added in quantitites sufficient to flocculate and thicken the pulp to a desired degree. Pulp densities are generally about 15 to 30% of solids by weight.

The flotation of barite is usually conducted on the alkaline side in a pH range from 8.0 to 12.0 or preferably, in a pH range from about 9.5 to 11.0. To adjust the pH, the thickened pulp is passed to a first conditioner where an alkaline hydroxide, preferably sodium hydroxide or sodium silicate, is used in a quantity sufficient to establish a pH in the desired range. The quantity of the alkaline material used will, of course, vary somewhat depending on the particular ore being beneficiated and the weather conditions.

In the first conditioner, a gangue depressant, such as sodium silicate, can be added. If desired, certain other frothers which do not interfere with the compositions of the present invention can also be added, e.g., natural oils such as pine oil and eucaliptus oil, or industrial products such as cresylic acid, higher alcohols, ethoxylated aliphatic and aromatic hydrocarbons and the like.

In addition to frothers and depressants, certain other chemical compounds, such as emulsifiers, dispersants, and modifiers may be added to the mineral slurry to enhance the phenomena of flotation and advantageously influence the separation of the desired mineral, or depress the undesired components of the ore.

The alkaline pulp, containing any frothers, emulsifiers, dispersants, depressants, and modifiers which may be added, is generally passed from the first conditioning tank to a second conditioning tank where the liquid compositions of the present invention, which serve as both frothers and collectors, are added.

The resulting suspension is then passed through a series of flotation cells where it is agitated and aerated with a gas such as compressed air. The barite is separated from gangue in the bubbles and is floated in the resulting froth. The froth is then skimmed off by means well-known in the art to obtain a concentrate of barite, while leaving gangue minerals in a tailing. Good flotation practice usually, though not always, involves flotation in rougher cells, followed by one or more cleanings of the rougher concentrate.

As already explained, the steps of the flotation process just described are conventional except for the novel use of the composition of the present invention.

$C_{8-34}$ alpha olefin sulfonates and salts thereof, active components in the inventive compositions, are by themselves efficient frothers and barite collectors. The alpha olefin sulfonates of the present invention contain at least about 8 carbon atoms, preferably from about 14 to about 34 carbon atoms, more preferably from about 16 to about 30 carbon atoms, and most preferably from about 16 to about 20 carbon atoms.

The $C_{8-34}$ alpha olefins which are to be sulfonated for use in the present invention can be linear olefins, nonlinear olefins, or mixtures thereof. The olefins can be obtained from both natural and polymerization sources. These sources may contain minor amounts of other constituents which do not unacceptably affect beneficiation. Useful $C_{8-34}$ alpha olefins are commercially available from Gulf Oil Corp. Ethyl Corp. and Shell Oil Corp.

Those skilled in the art understand that an "alpha olefin", while predominantly containing alpha olefins (vinyl olefins), is in fact a mixture of alpha olefins and other internal olefins, as well as diolefins and paraffin. Thus, a typical alpha olefin contains the following mixture of olefins:

Alpha (vinyl) olefin—70%-99%

Branched olefin—1.0 to 30%
Internal olefin—1.0 to 10%
Diolefin—up to 1%
Paraffin—up to 5%

Further, the olefins present in a commercially available alpha olefin are not of a single carbon chain length. Rather, commercially available alpha olefins are mixtures of olefins having varying carbon lengths.

Sulfonation procedures for alpha olefins are well-known in the art, and may be carried out by any one of several methods using $SO_3$, mixtures of $SO_3$ and $SO_2$ or organic sulfonating agents. Furthermore, the sulfonation can be carried out by either a batch-type process or by a continuous falling film reactor process. It is necessary, however, that an effective amount of the sulfonating agent be employed to ensure substantially complete conversion of the alkenes to the corresponding sulfonates.

Sulfonation of alpha olefins results in a mixture of various reaction products including some alpha olefin sulfonates, other sulfonated olefins, wherein the unsaturated double bond is present along the alkene chain in places other than alpha position, sultones, hydroxy alkyl sulfonates, disulfonates and minor amounts of other reaction products. As accepted by those skilled in the art, however, the mixture of sulfonates and other reaction products resulting from sulfonation of alpha olefins is nonetheless referred to as an alpha olefin sulfonate or a salt of an alpha olefin sulfonate.

An alpha olefin sulfonate useful in the present invention is the active component of a composition sold by Alcolac, Inc., 3440 Fairfield Road, Baltimore, Md. 21226 under the trade name Float Ore 168.

The compositions of the present invention also include acceptable salts of a $C_{8-34}$ alpha olefin sulfonate as an active component. These salts are obtained by neutralizing the sulfonated $C_{8-34}$ alpha olefins.

As defined herein, an acceptable $C_{8-34}$ alpha olefin sulfonate salt is one containing an appropriate cation which is able to neutralize the anionic acid function of the non-salt $C_{8-34}$ alpha olefin sulfonate. Illustrative acceptable salts include lithium, sodium, potassium, calcium, magnesium, salts of all other alkali and alkaline earth metals, salts of transition and heavy metals, ammonium, triethanolamine, and other nitrogen containing bases such as alkanolamines, alkyl alkanolamines and alkyl amines.

The $C_{8-34}$ alpha olefin sulfonates useful in this invention will generally be employed as the active component of a water solution. Accordingly, as used herein, an effective amount of a $C_{8-34}$ alpha olefin sulfonate or salt thereof, when these sulfonates are the only active components in a composition, is an amount sufficient to achieve the froth flotation and collection of barite. Thus, the amount of active $C_{8-34}$ alpha olefin sulfonate or salt thereof which can be used as a froth and collector reagent is not narrowly critical and can range from about 25 to about 3,000 grams, preferably from about 200 to about 1,000 grams, per ton of barite-containing ore processed. The preferably supplied activity of $C_{8-34}$ alpha olefin sulfonate or salts thereof when used as an exclusive active component is from about 225 grams to about 700 grams per ton of barite-containing ore processed.

EXAMPLE 1

Float Ore 168, an aqueous composition containing 32.2% by weight active alpha olefin sulfonate salt, (16.1% being sodium $C_{16}$ alpha olefin sulfonate salt and 16.1% being sodium $C_{18}$ alpha olefin sulfonate salt), 0.1% by weight sodium sulfate, 0.8% by weight petroleum ether extractables, 0.7% by weight sodium hydroxide and the balance water was tested as a barite collector. The barite-containing ore processed was a sample of hardrock mining waste from an operating mine in Georgia. It was crushed to pass 833 micrometers and thoroughly mixed. The results of these tests are shown in Tables 1 and 2.

The tests show that the active component of Float Ore 168, the alpha olefin sulfonate defined above, is an excellent barite collector when used alone. In fact, comparison of the data in Table 2 with that obtained for Float Ore 111, a $C_{16}/C_{18}$ alkyl sulfate in Table 3, to be discussed later, indicates that the active component of Float Ore 168 is sufficiently good that use of only about one-half as much active component in Float Ore 168 as used in Float Ore 111 obtains higher yields (distribution) of $BaSO_4$.

Tables 1 and 2 demonstrate an operational drawback relating to the use of the active component of Float Ore 168 by itself. Specifically, if the process continues too long, Float Ore 168, in addition to continuing to pull out $BaSO_4$, also begins to pull out undesirable minerals. Thus a lower purity (analysis) is obtained. Surprisingly, however, as will be demonstrated in Table 4, infra, admixture of Float Ore 168 with alkyl sulfates eliminates this operational disadvantage.

In Tables 1 and 2, 52.0% $BaSO_4$ was used as an assumed head analysis. The rougher tails and cleaner 2 concentrates from these tests were analyzed by X-ray fluorescence and two of the five tests were calculated to contain over 50% $BaSO_4$ in the two products alone. Consequently, the average head analysis was adjusted to 52% $BaSO_4$ to make the metallurgical balance work. This adjustment of figures, however, does not change the analysis of the rougher tail and the cleaner 2 concentrates.

TABLE 1

| | Reagents, lbs/ton | | Flotation | Cleaner 2 Conc. (analyzed[1]) | | | Combined Midds. 1&2 (calculated) | | | Rougher Tails (analyzed[1]) | | |
|---|---|---|---|---|---|---|---|---|---|---|---|---|
| | Na | Float | time | Wt. | $BaSO_4$, Pct. | | Wt. | $BaSO_4$, Pct. | | Wt. | $BaSO_4$, Pct. | |
| Test | Silicate | Ore 168 | minutes | Pct. | Analysis | Distribution[2] | Pct. | Analysis[2] | Distribution[2] | Pct. | Analysis | Distribution[2] |
| 1 | 2.0 | 1.5 | 2 | 52.7 | 91.5 | 92.7 | 12.2 | 20.6 | 4.8 | 36.1 | 3.51 | 2.5 |
| 2 | 2.0 | 1.5 | 5 | 57.5 | 88.0 | 97.3 | 10.8 | 9.0 | 1.9 | 31.7 | 1.35 | 0.8 |

[1]Analyzed by x-ray fluorescence
[2]All distribution pcts. and combined midds. analysis pct., calculated from head sample containing 52.00 pct. $BaSO_4$
Flotation condition applying to TABLE 1:
Feed size: minus 100 mesh
pulp pH: 10.3
conditioning time, min.: Na silicate, 2; Float Ore 168, 2

TABLE 2

| | Reagents, lbs/ton | | Flotation | Cleaner 2 Concentrate | | | Combined Midds. 1&2 | | | Rougher Tails | | |
|---|---|---|---|---|---|---|---|---|---|---|---|---|
| | Na | Float | time, | wt. | $BaSO_4$, pct. | | Wt. | $BaSO_4$, pct. | | Wt. | $BaSO_4$, pct. | |
| Test | Silicate | Ore 168 | minutes | pct. | Analysis | Distribution | pct. | Analysis | Distribution | pct. | Analysis | Distribution |
| 4 | 2.0 | 0.5 | 5 | 47.5 | 96.0 | 87.7 | 12.9 | 33.6 | 8.3 | 39.6 | 5.20 | 4.0 |
| 5 | 2.0 | 1.0 | 5 | 52.2 | 95.5 | 95.9 | 10.5 | 13.3 | 2.7 | 37.3 | 2.00 | 1.4 |
| 2 | 2.0 | 1.5 | 5 | 57.5 | 88.0 | 97.3 | 10.8 | 9.0 | 1.9 | 31.7 | 1.35 | 0.8 |
| 3 | 2.0 | 3.0 | 6 | 51.1 | 88.5 | 87.0 | 22.5 | 24.8 | 10.7 | 26.4 | 4.55 | 2.3 |

Flotation condition applying to TABLE 2:
Feed size: minus 100 mesh
pulp pH: 10.3
conditioning time, min.: Na silicate, 2; Float Ore 168, 2

As previously explained, a particular advantage of the present invention is that the $C_{8-34}$ alpha olefin sulfonates and salts thereof can be admixed with other barite collectors, including alkyl sulfates, tall oil fatty acids, mahogany petroleum sulfonates, sulfosuccinamates and salts thereof, to form compositions for enhancing the froth flotation and collection of barite.

When at least one $C_{8-34}$ alpha olefin sulfonate is admixed with another collector, an effective amount of each is that which contributes to a total amount of active components sufficient to achieve the froth flotation and collection of barite. The total amount of sulfonate and active component of another collector is thus not narrowly critical and can range from about 25 to about 6,000 grams per ton of barite-containing ore processed. Although the amount of alpha olefin sulfonate or salt thereof relative to other admixed active components may vary, at least about 0.25 grams alpha olefin sulfonate should be used per ton of barite-containing ore processed. Preferably, however, an admixture of alpha olefin sulfonates and other collectors has a supplied activity of from about 230 to about 340 grams of alpha olefin sulfonate and from about 340 to about 450 grams of other admixed active components per ton of barite-containing ore processed.

A previously-mentioned advantage of the present invention is that it improves the barite collecting efficiency of alkyl sulfates other than cetyl alkyl sulfates and tallow alkly sulfates. Absent the present invention, the weight range of effective alkyl sulfates is very narrow, as demonstrated in Table 3, which compares the overall collection efficiency as the alkyl equivalent weight increases from approximately 65/35 weight percent $C_{16}/C_{18}$, to approximately 35/65 weight percent $C_{16}/C_{18}$ to approximately 65/35 weight percent $C_{22}/C_{24}$ and up.

In Table 3, Float Ore 1200, commercially available from Alcolac, Inc., contains as an active component, a sodium behenyl sulfate salt made from a long chain alcohol having an approximate carbon length distribution of 2.1% by weight $C_{18}$ and lower, 4.9% by weight $C_{20}$, 58.4% by weight $C_{22}$, 24.1% by weight $C_{24}$, 8.0% by weight $C_{26}$ and 2.5% by weight $C_{28}$ and higher. Float Ores 111 and TS contain as active components sodium alkyl sulfate salts made, respectively, from a cetyl alcohol, having an approximate carbon length distribution of 65% by weight $C_{16}$ and 35% by weight $C_{18}$, and tallow alcohol, having an approximate carbon length distribution of 35% by weight $C_{16}$ and 65% by weight $C_{18}$.

The results in Table 3 indicate that while the analysis or purity of $BaSO_4$ remains high, i.e., greater than 97%, as the alkyl equivalent weight increases to the $C_{22}/C_{24}$ and up range in Float Ore 1200, the distribution, or yield, of $BaSO_4$ drops drastically to about 28% in the concentrate while undesirably rising to about 72% in the tails. Accordingly, the collector efficiency of Float Ore 1200 is very poor compared to that of both Float Ore TS and Float Ore 111.

TABLE 3

Comparison of $BaSO_4$ Collection from Barite Ore for Various Barite Collectors

| Trade Name | Product |
|---|---|
| Float Ore 111 | Sodium approximately 65/35 weight percent $C_{16}/C_{18}$ Sulfate |
| Float Ore TS | Sodium approximately 35/65 weight percent $C_{16}/C_{18}$ Sulfate |
| Float Ore 1200 | Sodium approximately 65/35 weight percent $C_{22}/C_{24}$ and up Sulfate |

| | Georgia Hardrock* | | |
|---|---|---|---|
| | Float Ore 111 | Float Ore TS | Float Ore 1200 |
| Concentrate | | | |
| Total: wt. % | 43.6 | 46.8 | 14.5 |
| Analysis: $BaSO_4$ %[1] | 98.2 | 98.0 | 97.4 |
| Distribution: $BaSO_4$ | 85.7 | 91.7 | 28.2 |
| Tails | | | |
| Total: wt. % | 56.4 | 53.2 | 85.5 |
| Analysis: $BaSO_4$ % | 12.7 | 7.8 | 53.6 |
| Distribution: $BaSO_4$ % | 14.3 | 8.3 | 71.8 |
| [1]$BaSO_4$ from known head analysis | 50.0 | 50.0 | 50.0 |
| Reagents lbs./ton: | | | |
| sodium silicate | 1.0 | 1.0 | 1.0 |
| Collector (active basis) | 2.0 | 2.0 | 2.0 |

*This was a sample of hardrock mining waste from an operating mine in Georgia. It was crushed to pass 833-micrometers and thoroughly mixed.

In the present invention, however, at least one $C_{8-34}$ alpha olefin sulfonate or salt thereof may be admixed with one or more $C_{8-34}$ alkyl sulfate, preferably, $C_{14-28}$ alkyl sulfate and most preferably, $C_{16-18}$ alkyl sulfate and salts thereof to form compositions for collecting barite. As known by those skilled in the art, $C_{8-34}$ alkyl sulfates and their neutralized salts are prepared by the sulfation and neutralization of commercially available long chain alcohols having carbon chain lengths from $C_8$ to $C_{34}$. As exemplified by tallow and cetyl alcohols, discussed above, commercial long chain alcohols are not pure substances, rather they are mixtures of alcohols having varying carbon lengths.

Suitable $C_{8-34}$ alkyl sulfate salts for admixture with the $C_{8-34}$ alpha olefin sulfonates or salts thereof contain an appropriate cation which is able to neutralize the anionic acid functions of the non-salt $C_{8-34}$ alkyl sulfate. Illustrative neutralized $C_{8-34}$ alkyl sulfate salts include lithium, sodium, potassium, calcium, magnesium, salts of all other alkali and alkaline earth metals, salts of transition and heavy metals, ammonium, triethanolamine, and other nitrogen containing bases such as alkanolamines, alkyl alkanolamines and alkyl amines.

$C_{8-34}$ alkyl sulfates and their salts suitable for admixture with the $C_{8-34}$ alpha olefin sulfonates or salts thereof can either be purchased commercially or made by processes well-known to those skilled in the art.

The results in Table 3 demonstrated that Float Ore 1200, a commercial behenyl sulfate, when used alone, is a relatively inefficient barite collector. Table 4, however, shows that an admixture designated as Float Ore 1262, commercially available from Alcolac, Inc., which contains about equal weights of the alpha olefin sulfonate active component of Float Ore 168 and the behenyl sulfate active component of Float Ore 1200, both of which have been described above, obtains over a 94% yield and also maintains an acceptable purity of $BaSO_4$.

Table 4 also demonstrates that an admixture designated Float Ore 1257, also commercially available from Alcolac, Inc., which contains about equal weights of the active component of Float Ore 168, described above, the active component of Float Ore 1200, described above and a myristyl ($C_{14}$) sulfate prepared from a long chain alcohol having approximate carbon chain length distributions of 4% by weight $C_8$, 54% by weight $C_{14}$, 36% by weight $C_{16}$ and 6% by weight paraffin, obtains over a 93% yield, as well as maintains an acceptable $BaSO_4$ purity.

Table 4 also repeats the results of Table 1 showing that the alpha olefin sulfonate Float Ore 168, by itself, is an excellent collector. Table 4 thus demonstrates both the suitability of an alpha olefin sulfonate as the exclusive active component of a barite collector composition and the suitability of an admixture of an alpha olefin sulfonate and a previously unacceptable barite collector as a barite collector composition.

TABLE 4

Comparative Studies of Various Alpha Olefin Products as Barite Collectors

| | Georgia Hardrock**** | | | Nevada Hardrock***** (de-slimed) | |
|---|---|---|---|---|---|
| | Float Ore 1257* | Float Ore 1262** | Float Ore 168*** | Float Ore 1257 | Float Ore 1262 |
| Concentration | | | | | |
| Total: Wt. % | 54.1 | 55.3 | 52.7 | 82.0 | 81.9 |
| Analysis: $BaSO_4$ %[1] | 86.7 | 85.3 | 91.5 | 92.2 | 92.4 |
| Distribution: $BaSO_4$ | 93.3 | 94.4 | 92.7 | 99.7 | 99.8 |
| Tails | | | | | |
| Total: Wt. % | 45.9 | 44.7 | 47.3 | 18.0 | 18.1 |
| Analysis: $BaSO_4$ % | 6.7 | 6.3 | 8.0 | 1.1 | 0.8 |
| Distribution: $BaSO_4$ % | 6.2 | 5.6 | 7.3 | 0.3 | 0.2 |
| [1]$BaSO_4$ from known head analysis | 50.0 | 50.0 | 50.0 | 75.8 | 75.8 |
| Reagents Lbs/ton: | | | | | |
| Sodium Silicate | 2.0 | 2.0 | 2.0 | 0.5 | 0.5 |
| Collector (active) | 1.5 | 1.5 | 1.5 | 2.0 | 2.0 |

*Float Ore 1257 0.67:0.33 active mixture of Float Ore 1262 and commercial myristyl sulfate

Float Ore 1262 1:1 active mixture of $C_{16}/C_{18}$ alpha olefin sulfonate/commercial behenyl sulfate*Float Ore 168 Sodium $C_{16}/C_{18}$ (commercial mixture) alpha olefin sulfonate.

****This was a sample of hardrock mining waste from an operating mine in Georgia. It was crushed to pass 833-micrometers and thoroughly mixed.

*****Coarse fraction from a pond being fed by the overflow from the primary desliming circuit in a current Nevada operation.

The $C_{8-34}$ alpha olefin sulfonates and their salts can also be admixed with compounds such as tall oil fatty acids, salts of tall oil fatty acids, mahogany petroleum sulfonates, salts of mahogany petroleum sulfonates, sulfosuccinamates and salts of sulfosuccinamates to form compositions which are highly efficient frothers and collectors of barite.

Useful tall oil acids ordinarily contain about 50% oleic acid, 40% linoleic acid, about 4% linolenic acid and about 6% residual resin acid content. The resin acids do not interfere with collecting ability.

Acceptable tall oil acid salts contain an appropriate cation able to neutralize the anionic acid factor of the non-salt tall oil fatty acid. Illustrative acceptable salts include lithium, sodium, potassium, calcium, magnesium, salts of all other alkali and alkaline earth metals, salts of transition and heavy metals, ammonium, triethanolamine, and other nitrogen containing bases such as alkanolamines, alkyl alkanolamines and alkyl amines.

Mahogany sulfonates are produced by sulfonating an appropriate petroleum fraction, such as California stock petroleum fraction containing from 30% to 36% aromatics, having a molecular weight of between 360 and 380, and a Saybolt universal viscosity of from 50 seconds to 55 seconds at 210° F., all of these figures applying to the oil prior to sulfonation. By "California stock" it is meant the ordinary oil field usage of the name, namely crude oil from California sources. The sulfonation of this stock is carried out in accordance with the usual procedures, which are set forth in a number of sources, such as U.S. Pat. No. 2,834,463, which discusses flotation of barite using petroleum sulfonate flotation agents and which is incorporated herein by reference.

Acceptable mahogany sulfonate salts contain an appropriate cation able to neutralize the anionic acid function of the non-salt mahogany sulfonates. Illustrative acceptable salts include lithium, sodium, potassium, calcium, magnesium, salts of all other alkali and alkaline earth metals, salts of transition and heavy metals, ammonium, triethanolamine, and other nitrogen containing bases such as alkanolamines, alkyl alkanolamines and alkyl amines.

Sulfosuccinamates and their salts can also be successfully admixed with the $C_{8-34}$ alpha olefin sulfonates. Acceptable salts contain an appropriate cation able to neutralize the anionic acid function of the non-salt sulfosuccinamate. Illustrative acceptable salts include lithium, sodium, potassium, calcium, magnesium, salts of all other alkali and alkaline earth metals, salts of transition and heavy metals, ammonium, triethanolamine, and other nitrogen containing bases such as alkanolamines, alkyl alkanolamines and alkyl amines.

We claim:

1. A method of beneficiating ore containing barite by a froth flotation process to produce a froth concentrate of barite while leaving gangue minerals in a tailing comprising the steps of:

suspending barite-containing ore in water;

including in said suspension an effective amount of at least one compound selected from the group consisting of a $C_{8-34}$ alpha olefin sulfonate and a salt of an alpha olefin sulfonate;

aerating said suspension to form bubbles containing barite-alpha olefin sulfonate complexes;

recovering a froth concentrate relatively rich in barite; and leaving a tailing relatively poor in barite.

2. The method of claim 1 wherein said compound is selected from the group consisting of a $C_{14-34}$ alpha olefin sulfonate and a salt of a $C_{14-34}$ alpha olefin sulfonate.

3. The method of claim 2 wherein said compound is selected from the group consisting of a $C_{16-30}$ alpha olefin sulfonate and a salt of a $C_{16-30}$ alpha olefin sulfonate.

4. The method of claim 3 wherein said compound is selected from the group consisting of a $C_{16-20}$ alpha olefin sulfonate and a salt of a $C_{16-20}$ alpha olefin sulfonate.

5. The method of claim 1 wherein said compound is included in an amount ranging from about 25 to 3,000 grams per ton of said barite-containing ore.

6. The method of claim 1 further including in said suspension an effective amount of at least one other admixed compound selected from the group consisting of a tall oil fatty acid, a salt of a tall oil fatty acid, a mahogany petroleum sulfonate, a salt of a mahogany petroleum sulfonate, a sulfosuccinamate, a salt of a sulfosuccinamate, a $C_{8-34}$ alkyl sulfate, and a salt of a $C_{8-34}$ alkyl sulfate.

7. The method of claim 6 wherein said compound and said other admixed compound are included in a total amount ranging from about 25 to 6,000 grams per ton of said barite-containing ore.

8. The method of claim 7 wherein said compound is included in an amount of at least about 0.25 grams per ton of said barite-containing ore.

9. The method of claim 6 wherein said other admixed compound is selected from the group consisting of a $C_{8-34}$ alkyl sulfate and a salt of a $C_{8-34}$ alkyl sulfate.

10. The method of claim 6 wherein said other admixed compound is selected from the group consisting of a $C_{14-28}$ alkyl sulfate and a salt of a $C_{14-28}$ alkyl sulfate.

11. The method of claim 6 wherein said other admixed compound is selected from the group consisting of a $C_{16-18}$ alkyl sulfate and a salt of a $C_{16-18}$ alkyl sulfate.

12. In a method for beneficiating ore containing barite by a froth flotation process to produce a froth concentrate of barite while leaving gangue minerals in a tailing, the improvement comprising the step of including an effective amount of at least one compound selected from the group consisting of a $C_{8-34}$ alpha olefin sulfonate and a salt of a $C_{8-34}$ alpha olefin sulfonate.

13. An aqueous composition for enhancing the froth flotation and collection of barite comprising as an active component about equal amounts by weight of (a) a composition having equal amounts by weight sodium $C_{16}$ alpha olefin sulfonate and sodium $C_{18}$ alpha olefin sulfonate; and (b) an alkyl sulfate made from a long-chain alcohol having an approximate carbon length distribution of 2.1% by weight less than or equal to $C_{18}$, 4.9% by weight $C_{20}$, 58.4% by weight $C_{22}$, 24.1% by weight $C_{24}$, 8.0% by weight $C_{26}$ and 2.5% greater than or equal to $C_{28}$.

14. An aqueous composition for enhancing the froth flotation and collection of barite comprising as an active component about equal amounts by weight of (a) a composition having equal amounts by weight sodium $C_{16}$ alpha olefin sulfonate and sodium $C_{18}$ alpha olefin sulfonate, (b) an alkyl sulfate made from a long-chain alcohol having an approximate carbon length distribution of 2.1% by weight less than or equal to $C_{18}$, 4.9% by weight $C_{20}$, 58.4% by weight $C_{22}$, 24.1% by weight $C_{24}$, 8.0% by weight $C_{26}$ and 2.5% greater than or equal to $C_{28}$, and (c) an alkyl sulfate made from a long-chain alcohol having an approximate carbon length distribution of 4% by weight $C_8$, 54% by weight $C_{14}$, 36% by weight $C_{16}$ and 6% by weight paraffin.

* * * * *